US006860400B2

(12) United States Patent
Lampe

(10) Patent No.: US 6,860,400 B2
(45) Date of Patent: Mar. 1, 2005

(54) CONTAINER WITH FRICTION DISPENSER

(75) Inventor: Scott A. Lampe, Wyoming, MI (US)

(73) Assignee: Caraustar Custom Packaging, Grand Rapids, MI (US)

( * ) Notice: Subject to any disclaimer, the term of this patent is extended or adjusted under 35 U.S.C. 154(b) by 65 days.

(21) Appl. No.: 10/391,047

(22) Filed: Mar. 18, 2003

(65) Prior Publication Data

US 2004/0182880 A1 Sep. 23, 2004

(51) Int. Cl.[7] ..... A47K 10/24

(52) U.S. Cl. ..... 221/45; 229/122.1

(58) Field of Search ..... 229/122.1, 240; 221/45, 33, 308, 305, 310, 307; 206/449, 494, 812

(56) References Cited

U.S. PATENT DOCUMENTS

| | | | | |
|---|---|---|---|---|
| 887,729 | A | 5/1908 | Kirmse | |
| 900,953 | A | 10/1908 | Reber | |
| 901,286 | A | 10/1908 | Ferres et al. | |
| 1,430,149 | A | 9/1922 | Bliss | |
| 1,995,286 | A | 3/1935 | Arzet | 229/58 |
| 1,998,717 | A | 4/1935 | Guyer | 229/51 |
| 2,011,438 | A | 8/1935 | Daller | 229/51 |
| 2,348,377 | A | 5/1944 | Goodyear | 229/51 |
| 2,367,476 | A | 1/1945 | Tyrseck | 229/44 |
| 2,369,387 | A | 2/1945 | Williamson et al. | 229/44 |
| 2,369,392 | A | 2/1945 | Ringler | 229/16 |
| 2,396,310 | A | 3/1946 | Yungblut | 229/44 |
| 2,403,698 | A | 7/1946 | Williamson et al. | 229/44 |
| 2,502,117 | A | 3/1950 | Anderson | 93/36.01 |
| 2,717,074 | A | 9/1955 | Williamson et al. | 206/58 |
| 2,766,923 | A | 10/1956 | D'Esposito | 229/23 |
| 2,794,588 | A | 6/1957 | George et al. | 229/45 |
| 2,836,343 | A | 5/1958 | Will | 229/51 |
| 2,848,153 | A | 8/1958 | Geiger, Sr. | 229/17 |
| 2,872,855 | A | 2/1959 | Fahrenkrug | 93/51 |
| 2,881,967 | A | 4/1959 | Ringler | 229/17 |
| 2,939,621 | A | 6/1960 | Mittleman | 229/17 |
| 2,951,627 | A | 9/1960 | Wenzel | 229/44 |
| 2,983,424 | A | 5/1961 | Glass | 229/27 |
| 3,008,569 | A | 11/1961 | Murch | 206/19.5 |
| 3,023,679 | A | 3/1962 | Piazze | 93/8 |
| 3,085,736 | A | 4/1963 | Meyers | 229/51 |
| 3,140,809 | A | 7/1964 | Hickin et al. | 229/37 |
| 3,161,346 | A | 12/1964 | Svensson | 229/51 |
| 3,168,974 | A | 2/1965 | Buttery et al. | 229/51 |
| 3,172,563 | A | 3/1965 | Harwood | 221/48 |
| 3,197,114 | A | 7/1965 | Holmes | 229/51 |
| 3,197,115 | A | 7/1965 | Peter | 229/51 |
| 3,198,420 | A | 8/1965 | Hiersteiner | 229/68 |
| 3,207,416 | A | 9/1965 | Koltz et al. | 229/44 |
| 3,249,283 | A | 5/1966 | Craddock et al. | 229/17 |
| 3,295,743 | A | 1/1967 | Redpath et al. | 229/51 |
| 3,321,354 | A | 5/1967 | Sloan et al. | 156/499 |

(List continued on next page.)

FOREIGN PATENT DOCUMENTS

| | | | |
|---|---|---|---|
| CA | 1017728 | 9/1977 | 229/19 |
| CA | 1323608 | 10/1993 | H05B/6/64 |
| DE | 2002995 | 7/1971 | |
| DE | 2046484 | 3/1972 | |
| DE | 3140389 A1 | 6/1983 | B65D/5/54 |
| GB | 2229996 A | 10/1990 | B65D/5/54 |
| JP | 5-97151 | 4/1993 | B65D/33/25 |

*Primary Examiner*—Kenneth Noland
(74) *Attorney, Agent, or Firm*—Summa & Allan, P.A.

(57) ABSTRACT

A container is provided for storing and dispensing objects in an easy-to-fill, easy-to-ship, and easy-to-use manner. The container is provided with a dispensing portion sized according to the size of the objects contained within the container such that the objects are dispensed only when desired. The dispensing portion is provided opposite an access opening allowing a user to use the dispensing portion in combination with the access opening to conveniently dispense the objects as required and further to prevent unintended dispensing of the contained items.

21 Claims, 6 Drawing Sheets

U.S. PATENT DOCUMENTS 3,322,264 A 5/1967 NcNair et al. ..... 206/45.25
3,345,918 A 10/1967 Simeone ..... 93/1
3,355,995 A 12/1967 Borkmann et al. ..... 93/1
RE26,371 E 4/1968 Schultz ..... 229/69
3,385,428 A 5/1968 Kugler ..... 206/57
3,432,090 A 3/1969 Engel ..... 229/51
3,434,849 A 3/1969 Carbone ..... 99/192
3,465,944 A 9/1969 Robinson ..... 229/5.5
3,514,032 A 5/1970 Pierce ..... 229/37
3,524,581 A 8/1970 Buttery ..... 229/51
3,537,360 A 11/1970 Farnam ..... 93/33
3,708,108 A 1/1973 Rosenburg, Jr. ..... 229/44
3,710,396 A 1/1973 Tomlinson ..... 2/197
3,727,827 A 4/1973 Stice ..... 229/37
3,744,702 A 7/1973 Ellison ..... 229/23
3,756,501 A 9/1973 Skillen et al. ..... 225/44
3,774,838 A 11/1973 Christie ..... 229/62
3,907,194 A 9/1975 Davenport et al. ..... 229/23
3,910,486 A 10/1975 Stone ..... 229/51
3,961,743 A 6/1976 Hollowell ..... 229/62
3,963,173 A 6/1976 Stone ..... 229/44
4,042,164 A 8/1977 Croley ..... 229/23
4,048,052 A 9/1977 Tolaas ..... 206/625
4,083,455 A 4/1978 Keating, Jr. ..... 206/625
4,102,457 A 7/1978 Meyers ..... 206/611
4,127,229 A 11/1978 Roccaforte ..... 229/44
4,136,816 A 1/1979 Gardner
4,141,449 A 2/1979 Stone ..... 206/621
4,284,193 A 8/1981 Roccaforte ..... 206/45.31
4,289,239 A 9/1981 Meyers ..... 206/625
4,314,643 A 2/1982 Forbes, Jr. ..... 206/626
4,531,669 A 7/1985 Osborne ..... 229/45
4,542,847 A 9/1985 Lindstrom ..... 229/16
4,679,694 A 7/1987 Donohie et al. ..... 206/611
4,688,677 A 8/1987 Roccaforte ..... 206/624
4,726,471 A 2/1988 Whately et al. ..... 206/554
4,732,315 A 3/1988 Gunn ..... 229/125.09
4,747,536 A 5/1988 Wischusen, III ..... 229/128
4,768,703 A 9/1988 Sosler et al. ..... 229/123.1
4,773,542 A 9/1988 Schillinger et al. ..... 206/626
4,871,345 A 10/1989 Wosaba, II et al. ..... 493/59
4,948,038 A 8/1990 Moeller ..... 229/146
4,981,256 A 1/1991 Giblin et al. ..... 229/125.09
4,986,420 A 1/1991 Gunn et al. ..... 206/607
4,997,087 A 3/1991 Lorenz ..... 206/422
5,014,905 A 5/1991 Cassidy ..... 229/113
5,036,982 A 8/1991 Aston ..... 206/611
5,054,644 A 10/1991 Greenslade ..... 220/403
5,092,516 A 3/1992 Kastanek ..... 229/226
5,129,875 A 7/1992 Chaygneaud-Dupuy ..... 493/335
5,148,973 A 9/1992 Zimmermann ..... 229/125.28
5,154,343 A 10/1992 Stone ..... 229/225
5,161,733 A 11/1992 Latif ..... 229/225
5,161,734 A 11/1992 Ruchl et al. ..... 229/227
5,170,934 A 12/1992 Lemoine ..... 229/101
5,215,248 A 6/1993 Moser ..... 229/23
5,219,089 A 6/1993 Kiolbasa et al. ..... 220/416
5,236,123 A 8/1993 Stone et al. ..... 229/225
5,238,179 A 8/1993 Hart ..... 229/117.13
5,249,681 A 10/1993 Miller ..... 206/427
5,265,799 A 11/1993 Stone ..... 229/225
5,277,360 A 1/1994 DeMott ..... 229/122
5,314,114 A 5/1994 Stone ..... 229/225
5,320,279 A 6/1994 Giblin et al. ..... 229/225
5,322,215 A 6/1994 Roccaforte ..... 229/225
5,325,989 A 7/1994 Karalus ..... 220/416
5,328,091 A 7/1994 Koss ..... 229/231
5,363,981 A 11/1994 Giblin et al. ..... 220/416
5,373,960 A 12/1994 Gunn et al. ..... 220/416
5,439,133 A 8/1995 Stone ..... 220/418
5,443,205 A 8/1995 Robotham et al. ..... 229/243
5,505,374 A 4/1996 Stone ..... 229/227
5,515,996 A 5/1996 Stone ..... 220/416
5,551,938 A 9/1996 Stone ..... 493/96
5,553,773 A 9/1996 Focke et al. ..... 229/224
5,624,031 A 4/1997 Fowler et al. ..... 206/391
5,673,849 A 10/1997 Stone ..... 229/227
5,725,144 A 3/1998 Stone et al. ..... 229/101
5,743,462 A 4/1998 Stone ..... 229/227
5,775,576 A 7/1998 Stone ..... 229/225
5,860,517 A * 1/1999 Gemma et al. ..... 206/63.3
6,176,419 B1 * 1/2001 Holley, Jr. ..... 229/122.1
6,669,083 B2 * 12/2003 Bates ..... 229/240

* cited by examiner

CONTAINER WITH FRICTION DISPENSER

FIELD OF THE INVENTION

The present invention relates generally to packaging and more specifically relates to a container for holding and dispensing cylindrical items.

BACKGROUND OF THE INVENTION

In the container industry, specialized containers have been developed for specific applications, including the needs of manufacturers and packagers, shipping needs, and the needs of consumers. An ideal package is easy to fill and assemble, convenient to ship, and easy for consumers to open and use. It is further preferred for a container to have a long useful life.

Small, cylindrical objects such as batteries have been packaged and shipped in many different types of containers. Traditionally, batteries have been packaged and shipped in paperboard cartons or in combined plastic-paperboard packages meant for hanging on hooks. Though these types of packaging have gained acceptance in the marketplace, they are somewhat inconvenient because of wasted material for display purposes, and they generally take up more room than is necessary to contain their contents. Further, these containers are easily damaged and do not provide convenient means for a user to access container contents over time.

There is a need for a carton for packaging, shipping, and dispensing small items that combines the features of being easy to fill and dispense with judicious use of construction materials and hardiness throughout the packaging, shipping, and consumer use cycles.

SUMMARY OF THE INVENTION

According to one embodiment of the present invention, a container is provided with an opening which holds contents within the container via frictional contact with the contents.

According to another embodiment of the present invention, a container is provided which enables easy dispensing of container contents while holding contents securely.

According to another embodiment of the present invention, a container is provided which enables an intuitive pushing motion to remove container contents while still providing secure holding of contents within the container.

According to still another embodiment of the present invention, a container is provided which enables easy tear-off access to the container's contents and which allows for repeated use of the container for dispensing purposes.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
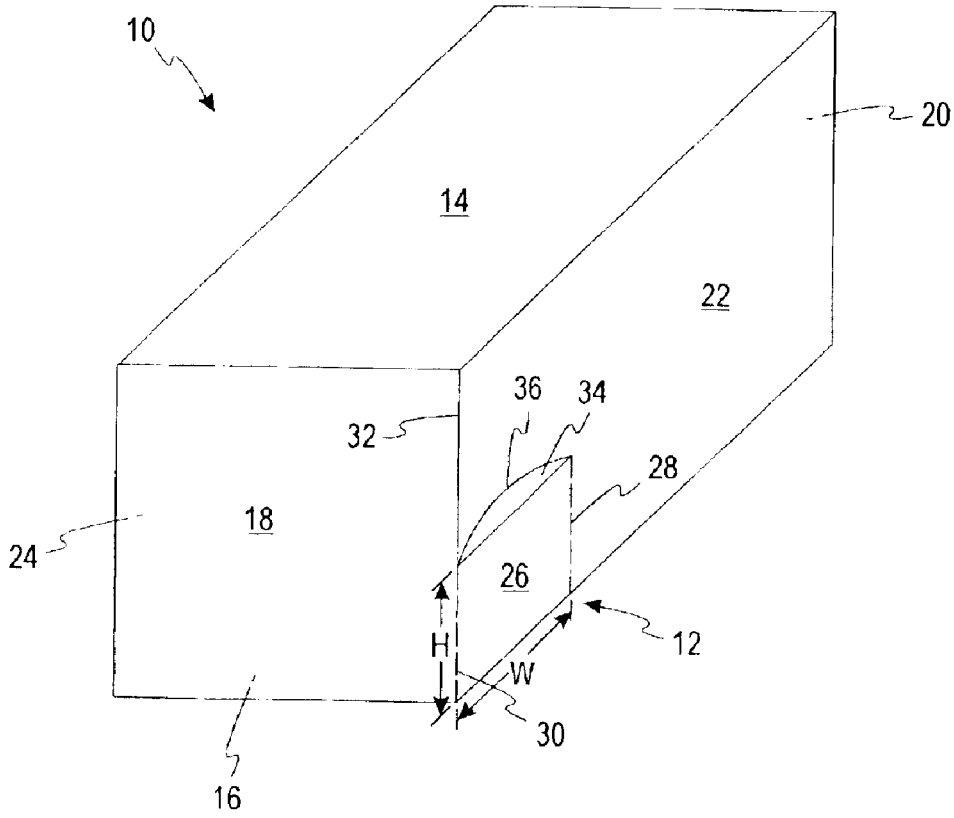
FIG. 1 is an isometric view of a container according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

A constant goal in designing packaging for products is the construction of a container which combines ease-of-use at the packing, shipping, and consumer stages while protecting the container's contents and keeping the contents within the package. The container 10 shown in FIG. 1 accomplishes these goals. According to one embodiment of the present invention, the container 10 is designed for holding and dispensing small, cylindrical objects such as batteries, pens, pencils, film cassettes, fuses, lip balm containers, sun-block containers, and the like. The container 10 makes use of a dispensing portion 12 to allow convenient dispensing of items from within the container.

The container 10 has a top panel 14, a bottom panel 16, a front panel 18, a back panel 20, and first and second side panels 22 and 24. According to the embodiment shown in FIG. 1, the dispensing portion 12 of the container 10 is disposed on the first side panel 22. It is to be understood that a container according to the present invention could alternatively be constructed with a dispensing portion located on another panel of the container 10.

During packing and shipment of the container 10, the dispensing portion 12 remains closed so that items contained within the container 10 do not slide out of the container due to the impacts and forces experienced by a container during shipment. The items are retained within the container 10 by a closure panel 26 affixed to the first side panel 22 along an attachment line 28 and further attached along a second attachment line 30 to the edge 32 formed by the first side panel 22 and the front panel 18. According to one embodiment of the present invention, to enable easy removal of the closure panel 26, the dispensing portion 12 is further provided with a removal opening 34, which provides a user with an opening for inserting a finger or other object to remove the closure panel 26.

According to one embodiment of the container 10, the dispensing portion 12 is provided with a width w approximately equal to or slightly less than a width of the contained items. Thus, even when the closure panel 26 is removed from the dispensing portion 12, the contained items will not slide out of the container 10 without an outside force acting on the item. According to one embodiment of the present invention, the dispensing portion is further provided with a height, h, approximately equal to or slightly less than a height of the contained items. Further, an upper edge 36 of the dispensing portion may be curved as shown in FIG. 1 to more closely fit curved items contained within the container 10. According to some embodiments, the top edge of the curve is slightly lower than a top edge of a contained object, to retain the contained object within the container 10 when removal is not wanted. Thereby, when the container 10 is made of a bendable or otherwise deformable material, objects may be removed from the container only when desired.

Figure 2:
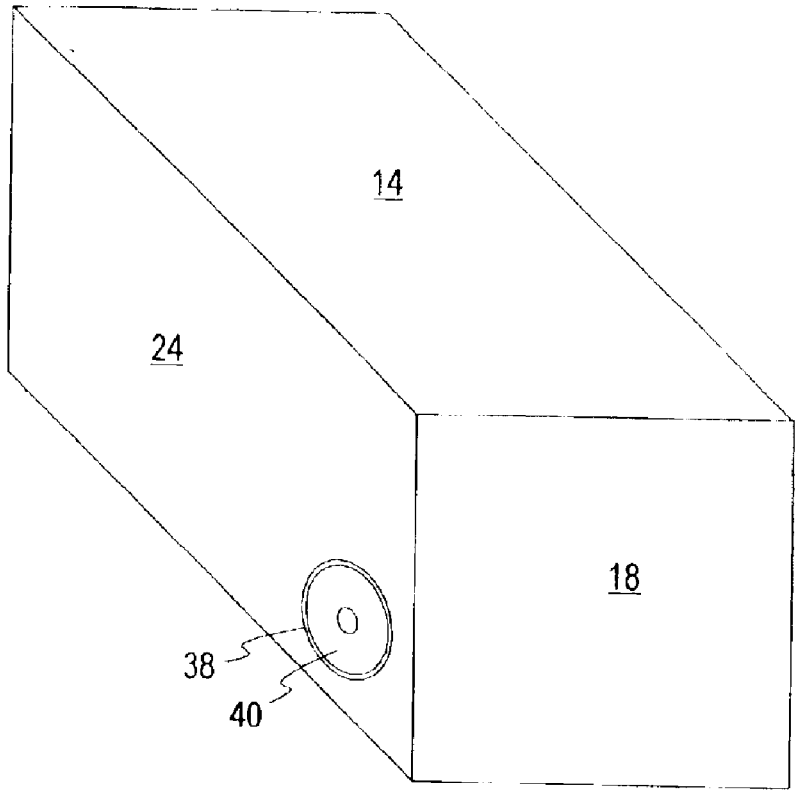
FIG. 2 is an isometric view of a container according to one embodiment of the present invention

Easy dispensing of contained items from the container may be allowed by the provision of an access opening 38 approximately opposing the dispensing portion 12, as shown in FIG. 2. This arrangement allows a user to push a finger or another object through the access opening 38 against an item 40 contained within the container 10. When the dispensing portion 12 is open, a force acting on the item 40 from the direction of the access opening 38 causes the item 40 to move outside the dispensing portion 12, where it may be grasped by a user.

Figure 3:
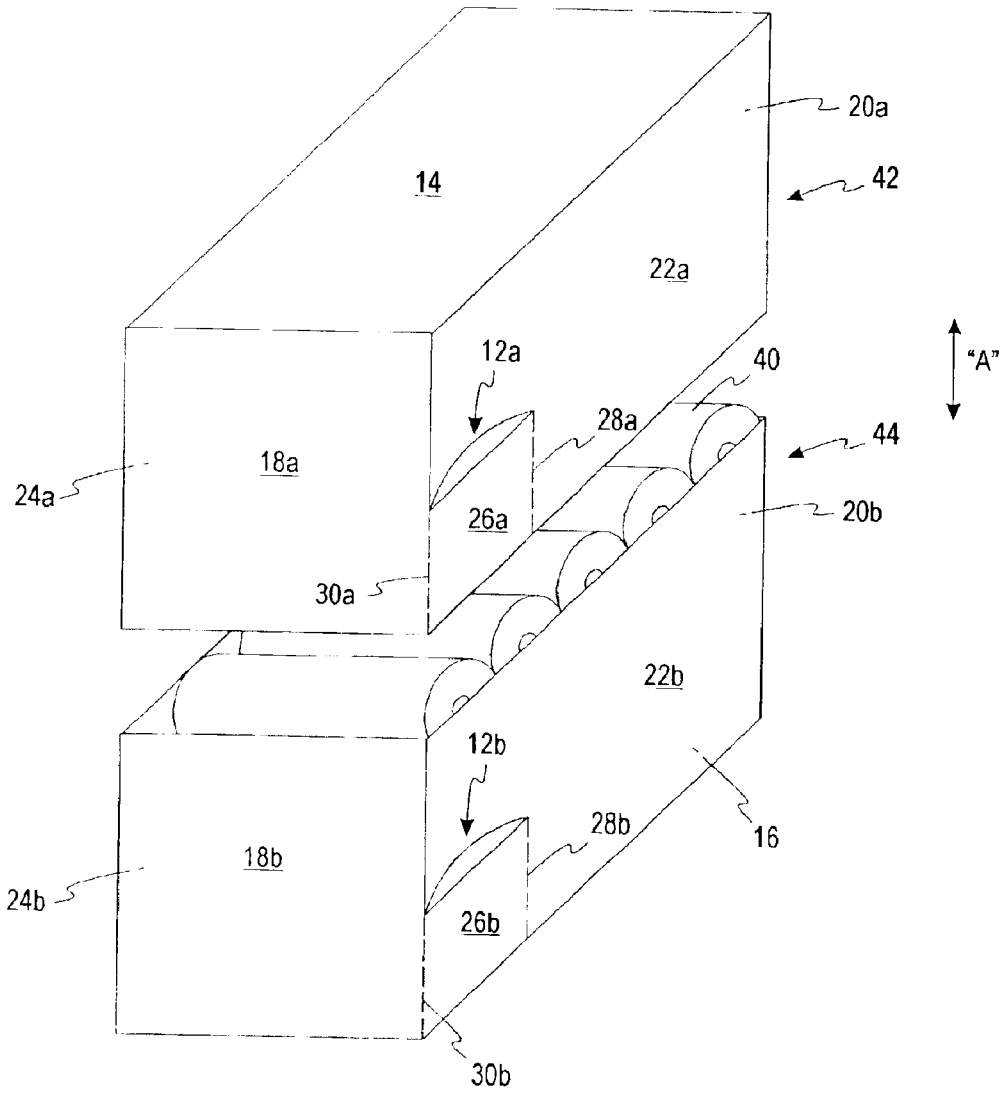
FIG. 3 is an isometric view of a container according to one embodiment of the invention, showing container lid and base portions.

Turning now to FIG. 3, an embodiment of the container 10 is shown in which the container 10 is provided with a lid member 42 and a base member 44, including a first dispensing portion member 12*a* and a second dispensing portion member 12*b*. The top panel 14 is at the top of the lid member 42, and the bottom panel 16 is at the bottom of the base member 44. Items 40 within the container 10 are shown stacked atop and alongside each other in an arrangement such that the removal of one item from the dispensing portion 12 causes other items to move toward the dispensing portion 12. In this embodiment, the closure panel 26 is constructed of first and second closure panel members 26*a* and 26*b*, with corresponding outer and inner attachment line members 28*a*, 28*b*, 30*a*, and 30*b*. According to one embodiment of the present invention, the attachment line members are comprised of perforated lines, though other types of weaknesses may be used, including scores. Further, in the embodiment shown in FIG. 3 the front panel 18 is constructed of outer and inner front panel members 18*a* and 18*b*. Likewise, the back panel 20 is constructed of outer and inner back panel members 20*a* and 20*b*, the first side panel 22 is constructed of outer and inner first side panel members 22*a* and 22*b*, and the second side panel 24 is constructed of outer and inner second side panel members 24*a* and 24*b*.

The container of the embodiment shown in FIG. 3 may be constructed by separately forming the lid member 42 and the base member 44 and sliding them together in the direction shown by arrow "A" of FIG. 3. It is preferred to have the lid member 42 sized with dimensions slightly wider than the dimensions of the base member 44 to enable easy sliding of the lid member 42 over the base member, but it is to be understood that the lid member 42 may be sized with dimensions slightly narrower than the dimensions of the base member 44 such that the lid member 42 may be slid into the base member 44.

Figure 4:
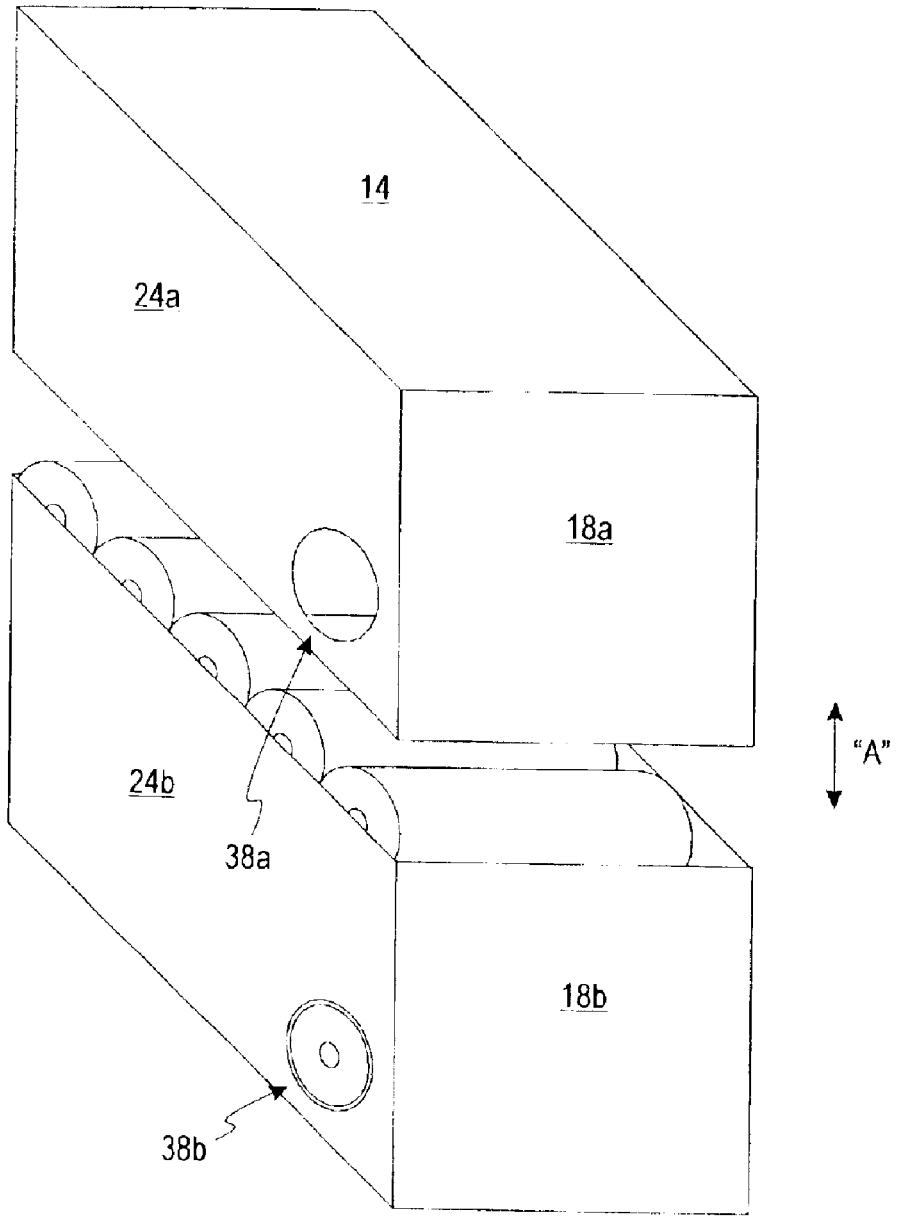
FIG. 4 is an isometric view of a container according to another embodiment of the present invention, showing container lid and base portions.

FIG. 4 shows another view of the two-part embodiment of the container 10 of the present invention. As shown in FIG. 4, the access opening 38 may be constructed of first and second access opening members 38*a* and 38*b*, disposed respectively on the lid member 42 and the base member 44 of the container 10. The two-part embodiment of a container according to the present invention has the benefits of being easy to fill and sturdy. Further, the doubling of the components of the dispensing portion 12 helps to ensure that the dispensing portion 12 will not open at unexpected or inappropriate times.

Figure 5:
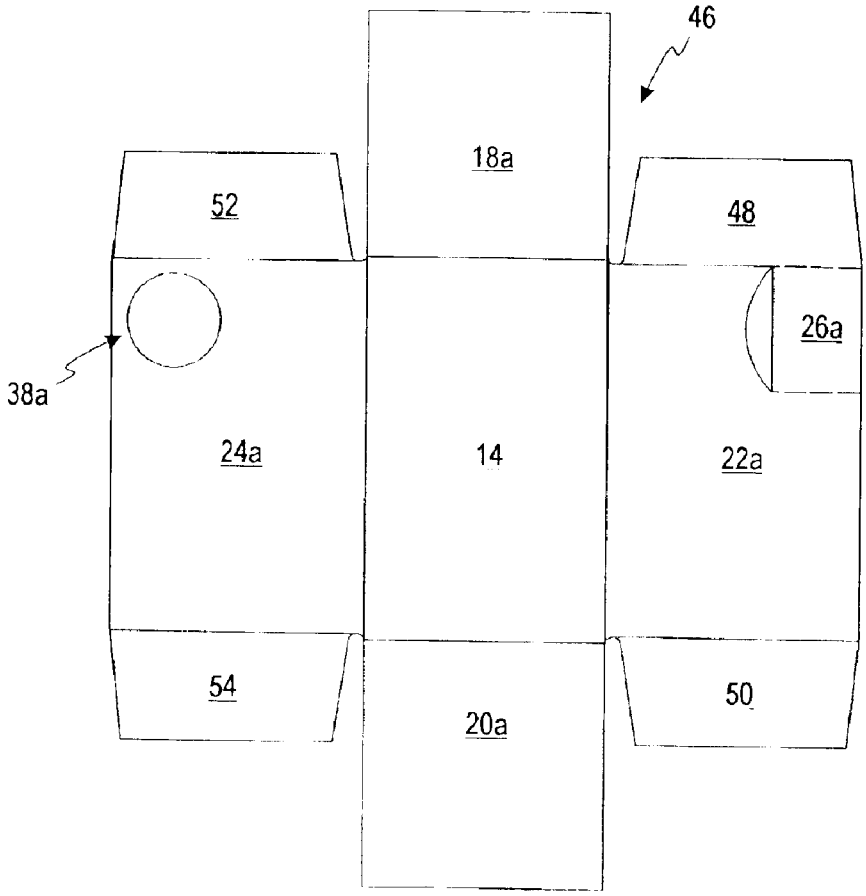
FIG. 5 is a plan view of a blank for manufacturing a container member according to one embodiment of the present invention.

Turning now to FIG. 5, a blank 46 for the construction of a container member according to one embodiment of the present invention is shown. The blank 46 of FIG. 5 is adapted for the formation of a lid member 42 in the embodiment of the present invention shown in FIGS. 3 and 4. As shown in FIG. 5, the top panel 14 is attached along fold lines to the outer front panel 18*a*, the outer back panel 20*a*, the outer first side panel member 22*a*, and the outer second side panel member 24*a*. The outer first side panel 22*a*, in turn, is connected along fold lines to a first outer front panel minor flap 48 and a first outer back panel minor flap 50. Likewise, the outer second side panel 24*a* is connected along fold lines to a second outer front panel minor flap 52 and a second outer back panel minor flap 54.

To construct the lid member 42 according to one embodiment of the present invention, the outer first and second side panels 22*a* and 24*a* are folded upwardly (toward the viewer) to an approximately perpendicular position with respect to the top panel 14. The outer minor flaps 48, 50, 52, and 54, are folded inwardly until they are approximately perpendicular, respectively, to the first and second outer side panels 22*a* and 24*a*. The outer front panel 18*a* is folded upwardly and connected to the first and second outer front panel minor flaps 48 and 52, and the outer back panel 20*a* is folded upwardly and connected to the first and second outer back panel minor flaps 50 and 54. These connections may be via adhesive, staples, or other types of connection known in the art of container design.

Figure 6:
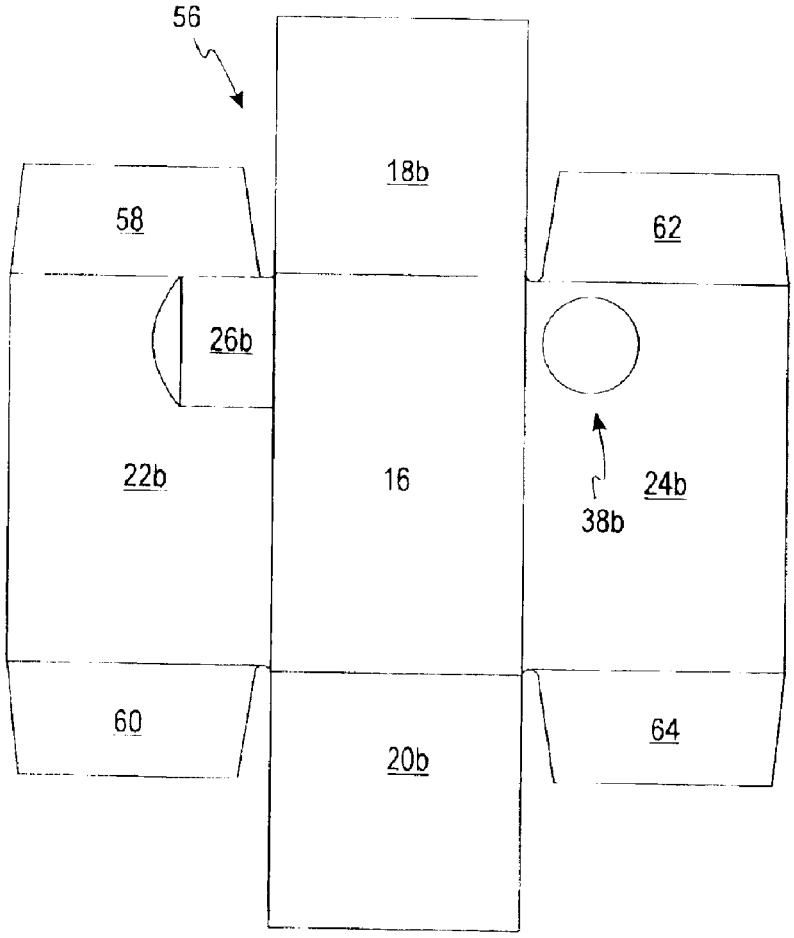
FIG. 6 is a plan view of a blank for manufacturing a container member according to one embodiment of the present invention.

FIG. 6 shows a blank 56 for constructing the base portion 44 of a container according to the present invention. The blank 56 includes a bottom panel 16 attached along fold lines to the inner front panel member 18*b*, the inner back panel member 20*b*, the inner first side panel member 22*b*, and the inner second side panel member 24*b*. The inner first side panel 22*b* member, in turn, is connected along fold lines to a first inner front panel minor flap 58 and a first inner back panel minor flap 60. Likewise, the inner second side panel member 24*b* is connected along fold lines to a second inner front panel minor flap 62 and a second outer back panel minor flap 64.

To construct the base member 44 according to one embodiment of the present invention, the inner first and second side panel members 22*b* and 24*b* are folded upwardly (toward the viewer) to an approximately perpendicular position with respect to the bottom panel 16. The inner minor flaps 58, 60, 62, and 64 are folded inwardly until they are approximately perpendicular, respectively, to the first and second inner side panel members 22*b* and 24*b*. The inner front panel member 18*b* is folded upwardly and connected to the first and second inner front panel minor flaps 58 and 62, and the inner back panel member 20*b* is folded upwardly and connected to the first and second inner back panel minor flaps 60 and 64. Similarly to the connections for the lid member 42, these connections may be via adhesive, staples, injection-molded plastic, or other types of connection known in the art of container design.

It is to be understood that the dimensions of blanks 46 and 56 could be altered such that panels located on the blank 46 become inner panels and the panels located on the blank 56 become outer panels, as may be convenient for some embodiments of a container 10 according to the present invention.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container for containing and dispensing objects comprising:

a bottom panel;

a top panel;

first and second side panels;

a dispensing portion provided either on said first or said second side panel, said dispensing portion having a width approximately equal to or narrower than a width of said objects; and an access opening provided on said side panel upon which said dispensing portion is not provided and approximately apposing said dispensing portion, said access opening sized to allow pushing of said objects through said access opening.

2. The container of claim 1 wherein said bottom panel is provided as part of a container base member and wherein said top panel is provided as part of a container lid member.

3. The container of claim 1 wherein said dispensing portion comprises a closure panel removable from said container along attachment lines.

4. The container of claim 3 wherein said closure panel includes inner and outer closure panel members.

5. The container of claim 4 wherein said inner closure member is provided on a container base member and wherein said outer closure panel member is provided on a container lid member, each of said inner and outer closure panel members having attachment lines associated therewith.

6. The container of claim 4 wherein said inner closure panel member is provided on a container lid member and wherein said outer closure panel member is provided on a container base member, each of said inner and outer closure members having attachment lines associated therewith.

7. A container for containing and dispensing objects comprising:

a lid member having a top panel and first and second outer side panel members extending downwardly from said top panel, said first outer side panel member having a first dispensing portion member disposed thereon, said second outer side panel member having a first access opening member provided thereon; and a base member having a bottom panel and first and second inner side panel members extending upwardly from said bottom panel, said first inner side panel member having a second dispensing portion member provided thereon, said second outer side panel member having a second access opening member provided thereon, said base member being so sized an to allow said lid member to be placed atop said base member such that said first outer side panel member abuts said first inner side panel member and said second outer side panel member abuts said second inner side panel member, said first dispensing portion member approximately aligning with said second dispensing portion member and said first access opening member approximately aligning with said second access opening member, said first and second dispensing portion members having first and second dispensing portion widths.

8. The container of claim 7 wherein said first and second dispensing portion member widths are approximately equal to each other and to widths of said objects.

9. The container of claim 7 wherein said second dispensing portion member is wider then said first dispensing portion member.

10. The container of claim 7 wherein said first dispensing portion member is wider than said second dispensing portion member.

11. The container of claim 7 wherein said objects are batteries.

12. A method of constructing a container for holding objects comprising:

providing a lid member having first and second outer side panel members, an outer front panel member, and an outer back panel member, said first outer side panel member having a first dispensing portion member provided thereon, and said second outer side panel member having a first access opening member provided thereon;

providing a base member having first and second inner side panel members, an inner front panel member, and an inner back panel member, said first inner side panel member having a second dispensing portion member provided thereon, and said second inner side panel member having a second access opening member provided thereon; and sliding said lid member together with said base member, thereby aligning said first and second access opening members to form an access opening and aligning said first and second dispensing portion members to form a dispensing portion, such that said dispensing portion is sized to hold objects within said container.

13. The method of claim 12 wherein said first and second dispensing portion members comprise, respectively, first and second closure panel members.

14. The method of claim 13 wherein said first closure panel member is attached to said lid member along first and second outer attachment line members.

15. The method of claim 13 wherein said second closure panel member is attached to said base member along first and second inner attachment line members.

16. A method of constructing a container comprising:

providing a lid member blank having a top panel, outer front and back panel members attached to said top panel along fold lines and first and second outer side panels attached to said top panel along fold lines, said first outer side panel having a first dispensing portion, a first outer front panel minor flap, and a first outer back panel minor flap provided thereon, said first dispensing portion comprising an outer closure panel member, said second outer aide panel having a first access opening member, a second outer front panel minor flap, and a second outer back panel minor flap provided thereon;

folding said first and second outer side panel members upwardly into positions approximately perpendicular to said top panel;

folding said first outer front panel rumor flap and said first outer back panel minor flap inwardly into positions approximately perpendicular to said first outer side panel member;

folding said second outer front panel minor flap and said second outer back panel minor flap into positions approximately perpendicular to said second outer side panel member;

folding said outer front panel member and said outer back panel member upwardly into positions approximately perpendicular to said top panel;

attaching said outer front panel member to said first and second outer front panel minor flaps;

attaching said outer back panel member to said first and second outer back panel minor flaps, thereby forming a container lid member;

providing a base member blank having a bottom panel, inner front and back panel members attained to said bottom panel along fold lines and first and second inner side panels attached to said bottom panel along fold lines, said first inner side panel having a second dispensing portion, a first inner front panel minor flap, and a first inner back panel minor flap provided thereon, said second dispensing portion comprising an inner closure panel member, said second inner side panel having a second access opening member, a second inner front panel minor flap, and a second inner back panel minor flap provided thereon;

folding said first and second inner side panels upwardly into positions approximately perpendicular to said top panel;

folding said first inner front panel minor flap and said first inner back panel minor flap inwardly into positions approximately perpendicular to said first inner side panel;

folding said second lunar front panel minor flap and said second inner back panel minor flap into positions approximately perpendicular to said second inner side panel;

folding said inner front panel and said inner back panel upwardly into positions approximately perpendicular to said bottom panel;

attaching said inner front panel to said first and second inner front panel minor flaps;

attaching said inner back panel to said first and second inner back panel minor flaps, thereby forming a container base member;

positioning said container lid member above said container base member; and sliding said container lid member and said container base member together such that said first and second access opening members abut each other and said first and second dispensing portion members abut each other.

17. A container for containing and dispensing objects comprising:

a bottom panel;

a top panel;

first and second side panels; and a dispensing portion provided either on said first or said second side panel, said dispensing portion having a width approximately equal to or narrower than a width of said objects;

wherein said dispensing portion comprises a closure panel having inner and outer closure panel members, said closure panel removable from said container along attachment lines.

18. The container of claim 17 further comprising an access opening provided on said panel upon which the dispensing portion is not provided and approximately opposing said dispensing portion, said access opening sized to allow pushing of said objects through said access opening.

19. The container of claim 17 wherein said bottom panel is provided as part of a container base member and wherein said top panel is provided as part of a container lid member.

20. The container of claim 17 wherein said inner closure panel member is provided on a container base member and wherein said outer closure panel member is provided on a container lid member, each of said inner and outer closure panel members having attachment lines associated therewith.

21. The container of claim 17 wherein said inner closure panel member is provided on a container lid member and wherein said outer closure panel member is provided on a container base member, each of said inner and outer closure panel members having attachment lines associated therewith.

* * * * *

UNITED STATES PATENT AND TRADEMARK OFFICE

CERTIFICATE OF CORRECTION

PATENT NO. : 6,860,400 B2
APPLICATION NO. : 10/391047
DATED : March 1, 2005
INVENTOR(S) : Scott A. Lampe It is certified that error appears in the above-identified patent and that said Letters Patent is hereby corrected as shown below:

In the claims:

Claim 1, col. 5, line 15 “apposing” should read -- opposing -- .

Claim 5, col. 5, lines 26 & 27,
“inner closure member” should read -- inner closure panel member -- .

Claim 6, col. 5, line 35 & 36,
outer closure members” should read -- outer closure panel members -- .

Claim 7, col. 5, line 51, “an” should read -- as -- .

Claim 9, col. 5, line 66, “then” should read -- than -- .

Claim 16, col. 6, line 46, “aide” should read -- side -- .

Claim 16, col. 6, line 52, “rumor” should read -- minor -- .

Claim 16, col. 7, line 2, “attained” should read -- attached -- .

Claim 16, col. 7, line 29, “lunar” should read -- inner -- .

Signed and Sealed this

Twenty-fifth Day of December, 2007

JON W. DUDAS
*Director of the United States Patent and Trademark Office*